US009890728B2

(12) United States Patent
Fulton et al.

(10) Patent No.: US 9,890,728 B2
(45) Date of Patent: Feb. 13, 2018

(54) ENGINE OPERATING SYSTEM AND METHOD

(71) Applicant: Ford Global Technologies, LLC, Dearborn, MI (US)

(72) Inventors: Brien Lloyd Fulton, West Bloomfield, MI (US); Michiel J. Van Nieuwstadt, Ann Arbor, MI (US); Daniel Roettger, Eynatten (BE); Aaron John Oakley, Chelmsford (GB); Claus Maerschank, Wuerselen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/832,409

(22) Filed: Aug. 21, 2015

(65) Prior Publication Data

US 2017/0051700 A1 Feb. 23, 2017

(51) Int. Cl.

| | |
|---|---|
| ***F02D 41/26*** | (2006.01) |
| ***F02D 41/14*** | (2006.01) |
| ***F02D 35/02*** | (2006.01) |
| *F02D 41/00* | (2006.01) |

(52) U.S. Cl.

CPC ..... *F02D 41/1497* (2013.01); *F02D 35/023* (2013.01); *F02D 35/028* (2013.01); *F02D 41/008* (2013.01); *F02D 2200/1004* (2013.01)

(58) Field of Classification Search

CPC ..... F02D 35/023; F02D 41/008; F02D 41/14; F02D 41/1441; F02D 41/26; F02D 41/263; G01M 15/00; G01M 15/05; G01L 23/22; Y02T 10/40

USPC ..... 123/350, 435, 436, 470–480; 701/102–105, 110, 114–115; 73/35.01, 73/35.07, 35.12, 114.17, 114.22, 114.33

See application file for complete search history.

(56) References Cited

U.S. PATENT DOCUMENTS

| | | | | |
|---|---|---|---|---|
| 6,866,024 | B2 * | 3/2005 | Rizzoni | F02D 35/024 123/406.22 |
| 7,623,955 | B1 | 11/2009 | Rackmail et al. | |
| 7,809,489 | B2 * | 10/2010 | Koeller | F02D 41/1497 123/435 |
| 7,853,393 | B2 | 12/2010 | Kettl et al. | |
| 7,921,700 | B2 | 4/2011 | Raichle et al. | |
| 8,375,677 | B1 | 2/2013 | Weiler | |
| 2006/0241852 | A1 * | 10/2006 | Damitz | F02D 35/023 701/114 |
| 2008/0148826 | A1 | 6/2008 | Raichle et al. | |
| 2010/0250089 | A1 * | 9/2010 | Buslepp | G01M 15/08 701/102 |

(Continued)

FOREIGN PATENT DOCUMENTS

WO 02071308 A1 12/2002

*Primary Examiner* — John Kwon
*Assistant Examiner* — Johnny H Hoang
(74) *Attorney, Agent, or Firm* — Julia Voutyras; McCoy Russell LLP

(57) ABSTRACT

Methods and systems for evaluating cylinder pressure profiles in cylinders of an engine are disclosed. In one example, fuel injection timing of engine cylinders is adjusted to improve engine combustion in response to output of one or more pressure sensors installed in engine cylinders. Combustion within a plurality of engine cylinders may be adjusted in response to pressure sensed in a single engine cylinder.

19 Claims, 7 Drawing Sheets

(56) References Cited

U.S. PATENT DOCUMENTS

2012/0004821 A1* 1/2012 Sano ..... F02D 35/023
701/101

* cited by examiner

EXAMPLE FIRING
ORDER
1-3-7-2-6-5-4-8

EXAMPLE FIRING
ORDER
1-3-7-2-6-5-4-8

ENGINE SPEED

| ENGINE LOAD BAR | 800 | 1000 | 1200 | 1400 | 1600 | 1800 | 2000 | 2200 | 2400 | 2600 |
|---|---|---|---|---|---|---|---|---|---|---|
| 3 | - | - | - | 1 | ALL | 2;7;8 | 1;2;4 | 1;2;3 | 1;3;4 | - |
| 6 | ALL | ALL | ALL | 1;7 | ALL | - | 1;6 | ALL | 1;2;3 | 1;4 |
| 9 | ALL | ALL | ALL | 2;3;5 | ALL | 1;4;5 | 1;5 | ALL | 1;2;3 | 1;2;3 |
| 12 | | | ALL | 1;2;3 | ALL | 1;2;3 | 2 | ALL | ALL | 1;2;3 |
| 15 | | | | 1;2;3 | ALL | 2;5;6 | - | ALL | - | 2;3;4 |

604 604 608

FIG. 6

ENGINE SPEED

| ENGINE LOAD BAR | 800 | 1000 | 1200 | 1400 | 1600 | 1800 | 2000 | 2200 | 2400 | 2600 |
|---|---|---|---|---|---|---|---|---|---|---|
| 3 | - | - | 2/28 | 7/28 | ALL | 22/28 | 22/28 | ALL | 25/28 | 1/28 |
| 6 | ALL | ALL | ALL | 17/28 | ALL | 5/28 | 19/28 | ALL | ALL | 14/28 |
| 9 | ALL | ALL | ALL | 22/28 | ALL | 21/28 | 21/28 | ALL | ALL | ALL |
| 12 | | | ALL | 25/28 | ALL | ALL | 10/28 | ALL | ALL | ALL |
| 15 | | | | ALL | ALL | 25/28 | 2/28 | ALL | 5/28 | 26/28 |

702 708

FIG. 7

ENGINE OPERATING SYSTEM AND METHOD

BACKGROUND/SUMMARY

Increasing lower engine emission standards call for increasingly more sophisticated engine controls. On way to improve engine operation is to install pressure sensors in engine cylinders. The pressure sensors may provide feedback that may be indicative of engine combustion for combustion location, combustion amount, quality, engine performance, durability and engine emissions for each of the cylinders that a pressure sensor is installed in and the engine itself. A pressure sensor may be installed in each engine cylinder so that a controller may evaluate the way the cylinder is operating. For example, if any of the mass fraction burn locations for an individual cylinder is delayed longer than is desired, engine fuel injection timing of that cylinder may be advanced to advance the crankshaft location of the mass fraction burn location during an engine cycle for the particular cylinder. Thus, cylinder pressure sensors may provide important and useful feedback of cylinder combustion and operation. However, installing a pressure sensor in each engine cylinder may increase engine cost and the amount of computational computing power that a controller may have to provide to process the cylinder pressure sensor data. Therefore, it would be desirable to be able to control the combustion process in each engine cylinder without having to cover the cost of installing a pressure sensor in each engine cylinder.

The inventors herein have recognized the above-mentioned disadvantages and have developed an engine operating method, comprising: evaluating operation of a plurality of engine cylinders for two or more engine cylinders by comparing the crankshaft signals between the indicated and non-indicated cylinders, but less than the plurality of engine cylinders, that provide lowest root mean square error values based a parameter; and installing pressure sensors in two or more engine cylinders, but less than the plurality of engine cylinders, that provide the lowest root mean square error values based on the parameter.

By selectively installing pressure sensors into only a fraction of engine cylinders that provide a lowest root mean square error value of an engine parameter based on pressure sensor output from the cylinders, it may be possible to provide the technical result of improving combustion in an engine without having to install a pressure sensor in each engine cylinder. Further, by installing pressure sensors in more than one engine cylinder, but in less that all engine cylinders, it may be possible to improve combustion by a greater extent for all the cylinders over the entire operating map than if only a single cylinder pressure sensor is installed in an engine. Specifically, two engine cylinder pressure sensors located in two different engine cylinders and that provide lowest root mean square error values for an engine parameter may be a basis for controlling combustion in all engine cylinders. For example, a pressure sensor positioned in cylinder number one of an engine and a pressure sensor located in cylinder number eight of the engine may provide lowest root mean square error values for determining engine torque at a plurality of engine speed and load conditions. The pressure sensors located in cylinder number one and eight may be the basis for modifying combustion in all engine cylinders over the engine operating range and expanding the operating range.

The present description may provide several advantages. For example, the approach may improve combustion in one or more engine cylinders. Further, the approach may reduce the cost of improving combustion in one or more engine cylinders. Further still, the approach may improve estimates of select engine control parameters by determining values of the engine control parameters based on pressure sensors that exhibit a higher signal to noise ratio.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 6 and 7 show example engine speed/load tables that show engine cylinders exhibiting lowest root mean square error torque values;

DETAILED DESCRIPTION

Figure 1:
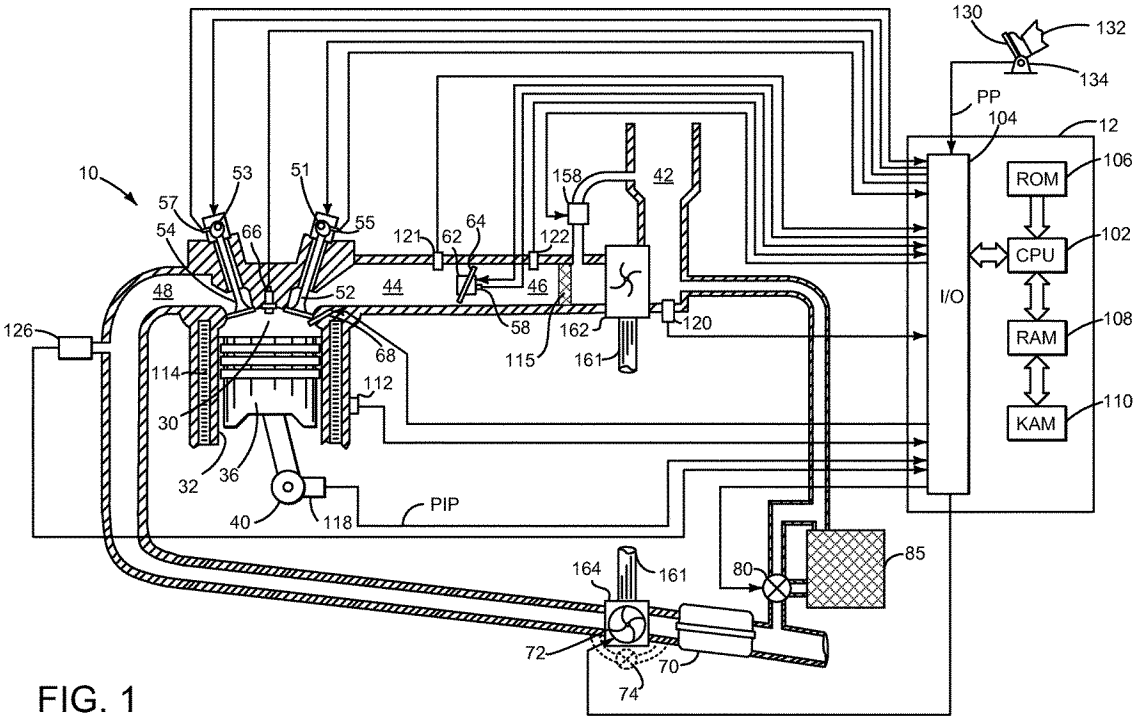
FIG. 1 shows a schematic depiction of an engine.
Figure 2:
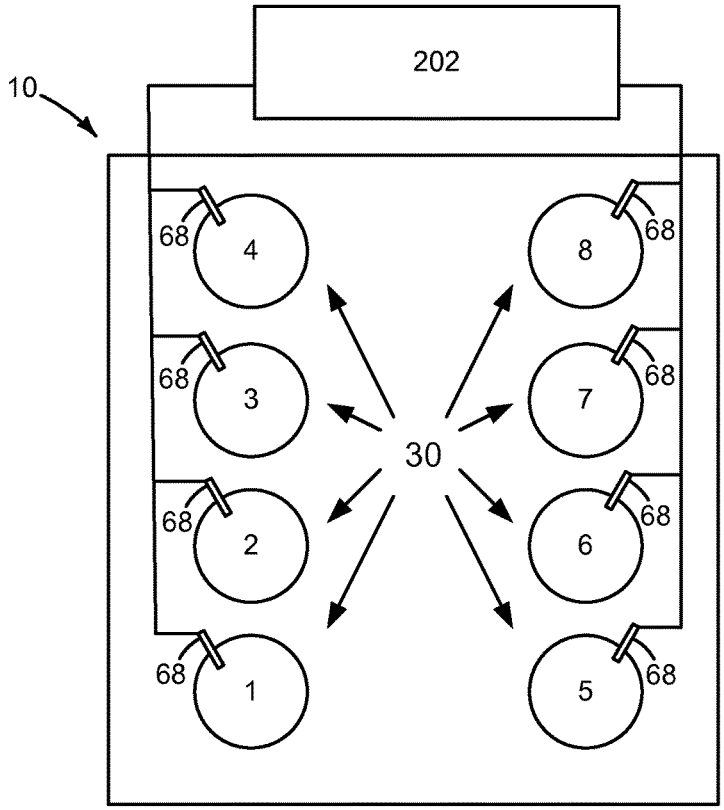
PRIOR ART FIG. 2
FIG. 2 shows an example prior art engine that includes a plurality of pressure sensors installed into a plurality of engine cylinders.
Figure 3:
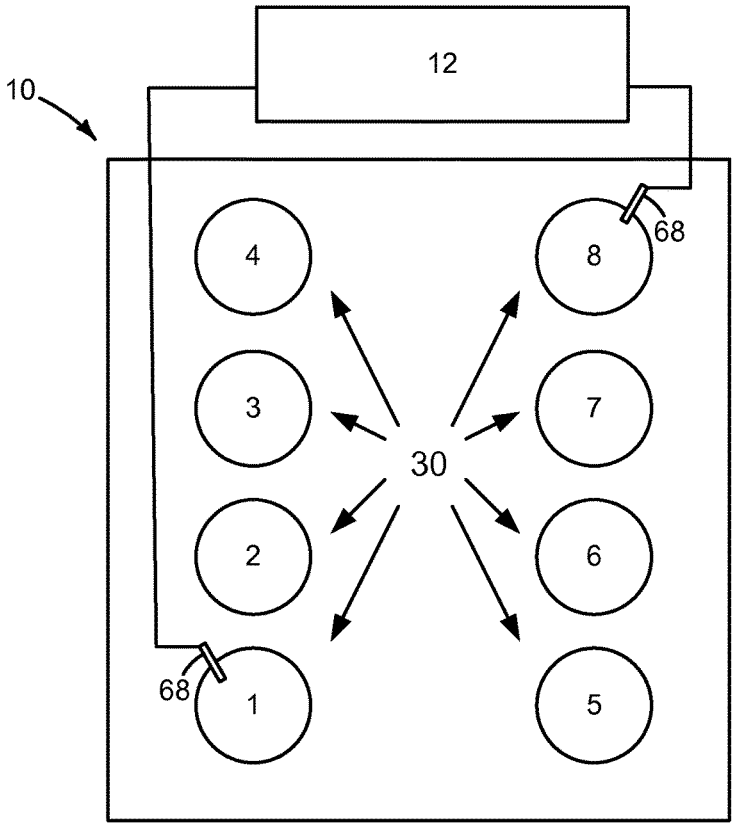
FIG. 3 shows an example of an engine according to the present invention.

The present description is related to improving combustion within cylinders of an internal combustion engine in response to pressure sensor feedback from pressure sensors located in cylinders based on root mean square errors of engine parameters. FIG. 1 shows an example cylinder of an internal combustion engine. FIG. 2 shows prior art locations for cylinder pressure sensors. FIG. 3 shows one example of locations for cylinder pressure sensors according to the present disclosure. FIGS. 4-8 show example ways of selecting locations for cylinder pressure sensors and deploying pressure sensors in engine cylinders. FIG. 9 shows an example method for operating an engine that includes pressure sensors.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Fuel injector 66 delivers fuel in proportion to a pulse width from controller 12. Fuel is delivered to fuel injector 66 by a fuel system (not shown) including a fuel tank, fuel pump, fuel rail (not shown). Fuel pressure delivered by the fuel system may be adjusted by varying a position valve regulating flow to a fuel pump (not shown). In addition, a metering valve may be located in or near the fuel rail for closed loop fuel control. A pump metering valve may also regulate fuel flow to the fuel pump, thereby reducing fuel pumped to a high pressure fuel pump.

Intake manifold 44 is shown communicating with optional electronic throttle 62 which adjusts a position of throttle plate 64 to control air flow from intake boost chamber 46. Compressor 162 draws air from air intake 42 to supply boost chamber 46. Exhaust gases spin turbine 164 which is coupled to compressor 162 via shaft 161. Charge air cooler 115 cools air compressed by compressor 162. Compressor speed may be adjusted via adjusting a position of variable vane control 72 or compressor bypass valve 158. In alternative examples, a waste gate 74 may replace or be used in addition to variable vane control 72. Variable vane control 72 adjusts a position of variable geometry turbine vanes. Exhaust gases can pass through turbine 164 supplying little energy to rotate turbine 164 when vanes are in an open position. Exhaust gases can pass through turbine 164 and impart increased force on turbine 164 when vanes are in a closed position. Alternatively, waste gate 74 allows exhaust gases to flow around turbine 164 so as to reduce the amount of energy supplied to the turbine. Compressor bypass valve 158 allows compressed air at the outlet of compressor 162 to be returned to the input of compressor 162. In this way, the efficiency of compressor 162 may be reduced so as to affect the flow of compressor 162 and reduce intake manifold pressure.

Combustion is initiated in combustion chamber 30 when fuel ignites via compression ignition as piston 36 approaches top-dead-center compression stroke. In some examples, a universal Exhaust Gas Oxygen (UEGO) sensor 126 may be coupled to exhaust manifold 48 upstream of emissions device 70. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures glow plug 68 may convert electrical energy into thermal energy so as to raise a temperature in combustion chamber 30. By raising temperature of combustion chamber 30, it may be easier to ignite a cylinder air-fuel mixture via compression. Controller 12 adjusts current flow and voltage supplied to glow plug 68. In this way, controller 12 may adjust an amount of electrical power supplied to glow plug 68. Glow plug 68 protrudes into the cylinder and it may also include a pressure sensor integrated with the glow plug for determining pressure within combustion chamber 30.

Emissions device 70 can include a particulate filter and catalyst bricks, in one example. In another example, multiple emission control devices, each with multiple bricks, can be used. Emissions device 70 can include an oxidation catalyst in one example. In other examples, the emissions device may include a lean NOx trap or a selective catalyst reduction (SCR), and/or a diesel particulate filter (DPF).

Exhaust gas recirculation (EGR) may be provided to the engine via EGR valve 80. EGR valve 80 is a three-way valve that closes or allows exhaust gas to flow from downstream of emissions device 70 to a location in the engine air intake system upstream of compressor 162. In alternative examples, EGR may flow from upstream of turbine 164 to intake manifold 44. EGR may bypass EGR cooler 85, or alternatively, EGR may be cooled via passing through EGR cooler 85. In other, examples high pressure and low pressure EGR system may be provided.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by driver 132; a measurement of engine manifold pressure (MAP) from pressure sensor 121 coupled to intake manifold 44; boost pressure from pressure sensor 122 exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle. In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

The system of FIG. 1 provides for an engine system, comprising: an engine having a plurality of combustion chambers; a first pressure sensor protruding into a first of the plurality of combustion chambers; a second pressure sensor protruding into a second of the plurality of combustion chambers; and a controller including instructions stored in non-transitory memory to adjust combustion in all engine cylinders in response to output of the first pressure sensor and not the output of a second pressure sensor at a first predetermined engine speed and load.

In some examples, the engine system includes where the first of the plurality of combustion chambers is a combustion chamber that exhibits a lowest root mean square error value of engine torque as determined from output from a cylinder pressure sensor located in the first of the plurality of combustion chambers at the first predetermined engine speed and load. The engine system further comprises additional controller instructions to adjust combustion in all engine cylinders in response to output of the second pressure sensor and not the first pressure sensor at a second predetermined engine speed and load. The engine system includes where the second of the plurality of combustion chambers is a combustion chamber that exhibits a lowest root mean square error value of engine torque as determined from output from a cylinder pressure sensor located in the second of the plurality of combustion chambers at the second predetermined engine speed and load. The engine system includes where the instructions adjust fuel injection timing and quantity for individual injections. The engine system further comprises additional controller instructions to adjust combustion in each of all engine cylinders in response to output of either the first pressure sensor or output of the second pressure sensor at a third predetermined engine speed and load.

Referring now to FIG. 2, a prior art example showing locations of cylinder pressure sensors for controlling combustion in engine 10 is shown. In this example, engine 10 includes eight cylinders having combustion chambers 30 that are numbered consecutively from 1-8. Each cylinder is shown including a pressure sensor 68. Each pressure sensor is input to controller 202. Combustion in each of the cylinders is adjusted in response to pressure feedback from a pressure sensor in the cylinder being controlled. For example, cylinder number one of engine 10 includes a pressure sensor 68. Fuel injected into cylinder number one is controlled in response to output of pressure sensor 68 installed in cylinder number one. Likewise, combustion in other engine cylinders is controlled similarly.

Referring now to FIG. 3, an example engine showing locations of cylinder pressure sensors for controlling combustion in engine 10 according to the present method is shown. In this example, engine 10 also includes eight cylinders having combustion chambers 30 that are numbered consecutively from 1-8. Only two pressure sensors 68 are shown installed in engine cylinders. In particular, cylinder number one and cylinder number eight each include one pressure sensor 68. Each pressure sensor is input to controller 12. Thus, the number of pressure sensor connections to controller 12 is significantly lower than for controller 202 shown in FIG. 2.

Cylinder pressure feedback provided by pressure sensor 68 located in cylinder number one may be the basis for controlling fuel injection timing and quantity for cylinders 1-8 at a first engine speed and load. Cylinder pressure feedback provided by pressure sensor 68 located in cylinder number eight may be the basis for controlling fuel injection timing for cylinders 1-8 at a second engine speed and load. Further, pressure feedback from pressure sensor 68 located in cylinder number one may be a basis for adjusting combustion in a first group of engine cylinders at a third engine speed and load while pressure feedback from pressure sensor 68 located in cylinder number eight may be a basis for adjusting combustion in a second group of engine cylinders, the second group of engine cylinders different than the first group of engine cylinders, at the third engine speed and load. For example, cylinder pressure feedback from cylinder number one may be the basis for controlling fuel injection timing in cylinders 1, 2, 7, 5, and 4 during a engine cycle (e.g., two revolutions for a four stroke engine) while cylinder pressure feedback from cylinder number eight may be the basis for controlling fuel injection timing in cylinders 8, 3, and 6 during the same engine cycle. Thus, combustion in less than all engine cylinders is controlled based on cylinder pressure data observed by a single pressure sensor during a cylinder cycle, while during a same engine cycle, combustion in other engine cylinders is adjusted based on output of a different single pressure sensor.

Figure 4:
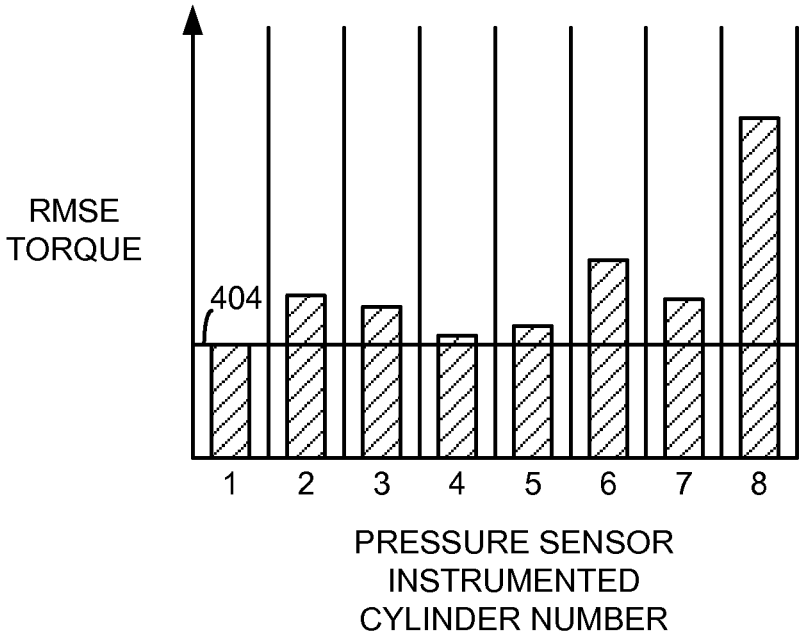
FIGS. 4 and 5 show example bar graphs to describe a method of selecting engine cylinders to receive pressure sensors.

Referring now to FIG. 4, a bar graph shows prophetic data for selecting which of engine cylinders is fitted with a pressure sensor. The vertical axis represents root mean square error (RMSE) for an engine parameter described by the following equation:

$$RMSE=\sqrt{(\hat{T}-T)^2}$$

where in this example, $\hat{T}$ is engine torque estimated based on the cylinder pressure and T is crankshaft measured engine torque. Alternatively, if a plurality of engine torque values is estimated from cylinder pressure, the RMSE may be given by:

$$RMSE=\sqrt{\frac{\sum_{t=1}^{n}\left(\hat{T}(t)-T\right)^2}{n}}$$

where in this example, n is the total number of data samples, t is the sample number, $\hat{T}$ is engine torque estimated based on the cylinder pressure, and T is measured engine torque. In some examples, indicated mean effective cylinder pressure (IMEP), percent mass fraction (e.g., 0-100) burned (MFB), or other engine parameter may be substituted for engine torque to determine RMSE values for selecting a cylinder in which to deploy a cylinder pressure sensor. The horizontal axis represents cylinder number, eight cylinders in this example. The height of each bar indicates the RMSE value for engine torque as determined based on a cylinder pressure sensor located within the respective cylinders 1-8. Higher bars indicate higher RMSE values.

In this example, at a particular engine speed and load, cylinder number one provides a lowest RMSE value for engine torque. Thus, engine torque as determined from a cylinder pressure sensor located in cylinder number one is closest in value to engine torque as determined from a reference standard engine torque (e.g., dynamometer determined engine torque). The RMSE value is indicated by line 404. Cylinder number four provides the second lowest RMSE value at this particular engine speed and load condition. Thus, if the location for a cylinder pressure sensor was selected based solely on the bar graph of FIG. 4, cylinder number one would be selected to receive the cylinder pressure sensor because it provides a signal that provides a best engine torque estimate as compared to the standard. By selecting cylinder number one, the signal to noise ratio for the cylinder pressure sensor may be improved.

Figure 5:
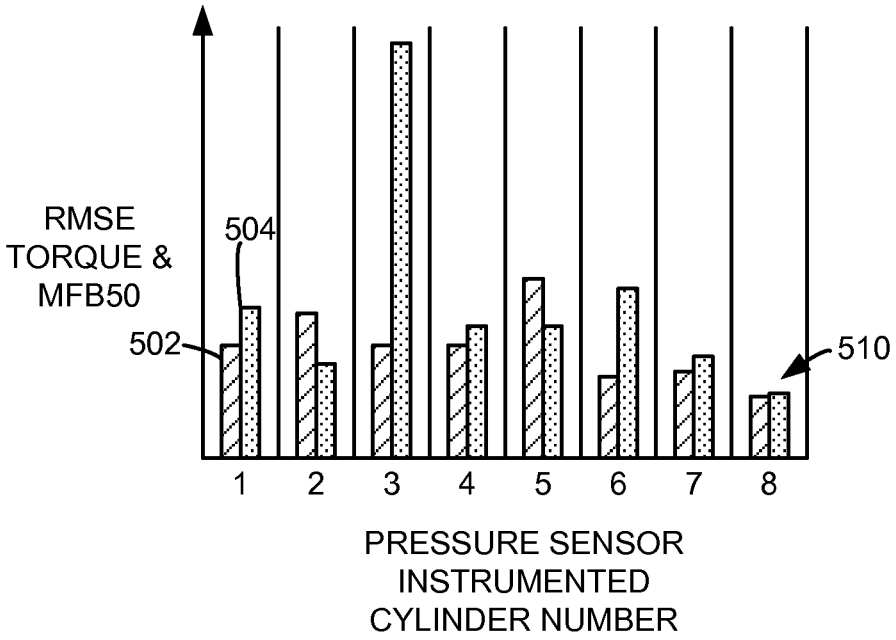

Referring now to FIG. 5, a bar graph shows prophetic data for selecting which of engine cylinders is fitted with a pressure sensor. The vertical axis represents root mean square error (RMSE) for engine torque and mass fraction burned 50 (e.g., MFB50—crankshaft location where 50 percent of the mass in the cylinder is burned). The horizontal axis represents cylinder number, eight cylinders in this example. The height of each bar indicates the RMSE value for engine torque and MFB50 as determined based on a cylinder pressure sensor located within the respective cylinders 1-8. The RMSE value increases as the height of the bar increases. The bars marked like bar 502 represent engine torque RMSE. The bars marked line bar 504 represent MFB50 RMSE for the cylinder indicated below the bar.

In this example, both the engine torque RMSE value and the MFB50 RMSE value for cylinder number eight is lower than for all other engine cylinders at this particular engine speed and load condition. Therefore, based on this bar graph data it is desirable to select engine cylinder number eight as the engine cylinder that receives a cylinder pressure sensor.

A matrix of engine operating conditions at different engine speeds and loads may be the basis for testing cylinder pressure sensor locations and values of engine parameters that are based on the different pressure sensor locations. For example, the measured vs. non-measured correlation and RMSE values for engine torque, MFB50, and other engine parameters may be determined at engine speeds ranging from 500 RPM to 6000 RPM in 500 RPM increments. Further, the same parameters may be determined at engine loads ranging from 3 bar to 15 bar, in 3 bar increments. In this way, best cylinders for receiving pressure sensors may be determined.

Referring now to FIG. 6, a prophetic table that indicates which engine cylinders provide lowest RMSE torque, MFB50 location, or other engine parameter at predetermined engine operating conditions (e.g., engine speed and load conditions) when only one pressure sensor located in one engine cylinder is provided. Thus, for an eight cylinder engine, the one cylinder pressure sensor may be located in one of eight possible cylinders. The horizontal cells represent various engine speeds as indicated at the top of the table. The vertical cells represent various engine loads (bar) as indicated along the vertical axis of the table. For example, cell 602 represents engine operating conditions of 1600 RPM and 15 bar load. The values in each of the cells represent cylinder numbers that provide the lowest RMSE value and best correlation for the selected engine parameter (e.g., torque). Cell 602 and other cells include the word "ALL" instead of numbers, and "ALL" indicates that all engine cylinders provide low RMSE values. In one alternative example, engine cylinders exhibiting RMSE values of engine parameters less than a threshold value as determined from cylinder pressure sensors may be selected to receive cylinder pressure sensors. Cell 608 includes the numbers 2, 5, and 6 to indicate that cylinder numbers 2, 5, and 6 provide low RMSE values for the selected engine parameter. A "-" indicates that no engine cylinder provides an acceptable RMSE value for the selected engine parameter. In this example, table cells like those bounded by the wide border 602, represent engine operating conditions where none or only a few engine cylinders provide acceptable RMSE (e.g., less than a threshold value) values for the engine parameter. In addition, table cells that are empty may be speed/load conditions where cylinder pressure is not used to modify engine combustion.

Thus, the table shown in FIG. 6 indicates that when only a single pressure sensor is the basis for controlling combustion in all engine cylinders, the single pressure sensor may not provide desirable data for some operating conditions. Consequently, if fuel injection is adjusted based on output of the single pressure sensor at the areas outlined with the wide border, combustion in engine cylinders may not improve as desired.

Referring now to FIG. 7, a prophetic table that indicates which engine cylinders provide lowest RMSE torque, MFB50 location, or other engine parameter at predetermined engine operating conditions (e.g., engine speed and load conditions) when only two pressure sensors located in two engine cylinders is provided. Thus, for an eight cylinder engine, the two cylinder pressure sensors may be located in any two of eight cylinders. The horizontal cells represent various engine speeds as indicated at the top of the table. The vertical cells represent various engine loads (bar) as indicated along the vertical axis of the table. The values in each of the cells represent cylinder numbers that provide the lowest RMSE value for the selected engine parameter (e.g., torque). Cells that include the word "ALL" instead of numbers indicate that all engine cylinders provide acceptable RMSE values. A "-" indicates that no engine cylinder provides a low RMSE value for the selected engine parameter. Because the engine includes eight cylinders with two pressure sensors in different cylinders, there are 28 different sensor combination possibilities.

Cell 708 includes the numbers 25/28. The number 28 represents the number of different sensor combination possibilities and the number 25 represents the number of sensor locations that provide a low RMSE value or RMSE value below a threshold value. Thus, 25 of the 28 possible cylinder pressure combinations provide low RMSE values for the engine parameter. 2, 5, and 6 to indicate that cylinder numbers 2, 5, and 6 provide low RMSE values for the selected engine parameter. In this example, there are only two table areas bounded by the wide border 702 that indicate there are none or only a few engine cylinders that provide low RMSE values for the engine parameter. Further, the number of possible alternative cylinders in which the pressure sensors provide low RMSE values is increased.

Thus, the table shown in FIG. 7 indicates that when only two pressure sensors are the basis for controlling combustion in all engine cylinders, the two pressure sensors may provide more opportunities to provide desirable parameter values based on pressure sensor data. Consequently, if fuel injection is adjusted based on output of the two pressure sensors that are a basis for determining low RMSE value engine parameters, the likelihood of computing undesirable engine parameter values may decrease.

Figure 8:
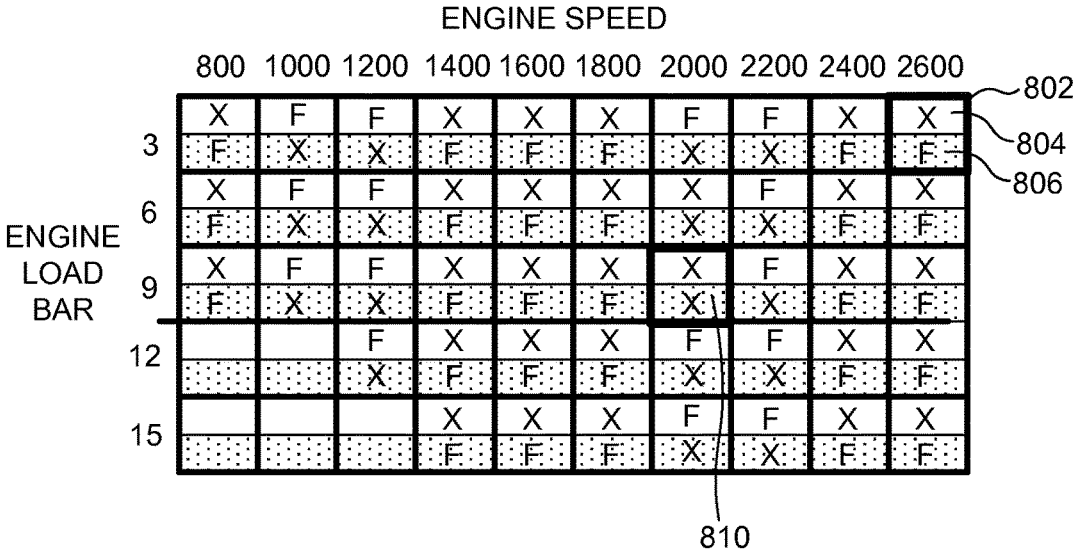
FIG. 8 shows an example table that describes operating conditions at which output of one or more cylinder pressure sensors is a basis for controlling combustion in all engine cylinders.
Figure 9:
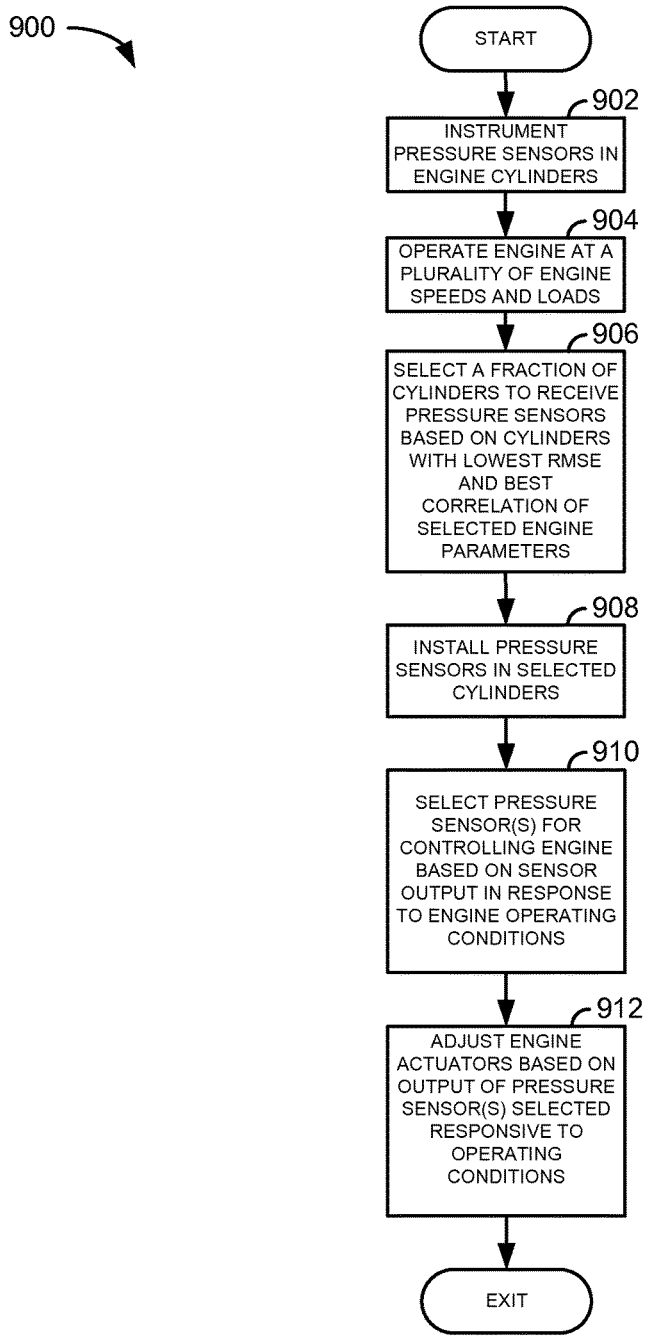
FIG. 9 shows a method for operating an engine.

Referring now to FIG. 8, a prophetic table that indicates which of two cylinder pressure sensors is the basis for adjusting combustion within engine cylinders. The horizontal cells represent various engine speeds as indicated at the top of the table. The vertical cells represent various engine loads (bar) as indicated along the vertical axis of the table. Each of the engine speed and load conditions is represented by a cell as shown by widely outlined cell 802. Each cell is subdivided into two cells similar to 804 and 806. Cells that have no shaded background, such as cell 804, represent the operating state for when the first pressure sensor is located in a first cylinder selected based on data in a table that is similar to the table shown in FIG. 7. Cells that have a shaded background, such as cell 806, represent the operating state for when the second pressure sensor is located in a second cylinder selected based on data in a table that is similar to the table shown in FIG. 7.

An "X" in a cell represents that the associated sensor is active and combustion adjustments for engine cylinders are based on data from the sensor indicated by the "X." A "F" in the cell represents that the associated sensor's output may be used for features such as determining IMEP for the cylinder in which the pressure sensor is installed. Thus, based on cell 802, at 2600 RPM and 3 bar load, the combustion adjustments for all engine cylinders are based on output of the first pressure sensor, the first pressure sensor located in a first cylinder. The second pressure sensor output may be used for features.

For the table cell indicated by 810, the first pressure sensor in a first cylinder (e.g., cylinder number 3) and the second pressure sensor in a second cylinder (e.g., cylinder number 5) are the basis for combustion adjustments for all engine cylinders based on output of the first and second pressure sensors. The combustion adjustments of cell 810 are for when engine speed is 2000 RPM and engine load is 9 bar. The combustion adjustments may increase or decrease cylinder pressure and/or advance or retard MFB50 and/or MFB10. Further, the combustion adjustments may increase or decrease select exhaust gas constituents (e.g., reduce HC in cylinder exhaust products).

Referring now to FIG. 9, a method for operating an engine is shown. At least portions of the method of FIG. 9 may be incorporated as instructions stored in non-transitory memory of a controller. Further, other portions of the method of FIG. 9 may be carried out as actions performed in the physical world via an individual and/or a controller.

At 902, an engine is instrumented with pressure sensors. One pressure sensor may be fitted to each engine cylinder, or alternatively, a single pressure sensor may be rotated between the different engine cylinders while the engine is repeatedly operated at a plurality of operating conditions. The pressure sensors provide and electrical output (e.g., a voltage) that is proportional to cylinder pressure. Method 900 proceeds to 904 after pressure sensors are installed in the engine.

At 904, the engine is operated at a plurality of operating conditions. Cylinder pressure data and engine parameters are collected to memory of a controller. The controller may determine values of engine parameters, such as engine torque and MFB50, based on cylinder pressure sensor output at the various operating conditions for each engine cylinder. In addition, engine parameters that are not based on cylinder pressure sensors may also be determined. For example, engine torque may be determined via a dynamometer load cell. Method 900 also determines RMSE values for each engine cylinder based on cylinder pressure sensor output. RMSE values may be determined as described for FIG. 4. Method 900 proceeds to 906 after cylinder pressure data and engine parameter values are stored to memory of a controller or database.

At 906, a fraction of engine cylinders are selected to receive cylinder pressure sensors based on pressure sensor output in engine cylinders that provided lowest RMSE values and best correlation for engine parameters. The RMSE values are based on cylinder pressure sensor output, and less than all engine cylinders are selected to receive cylinder pressure sensors. In one example, two engine cylinders are selected to receive cylinder pressure sensors based on data maps similar to the tables shown in FIGS. 6 and 7. The cylinders selected are based on output of pressure sensors in engine cylinders that provide the lowest RMSE values for one or more engine parameters (e.g., engine torque, MFB50, MFB10, crankshaft tooth time, or other engine parameter) over the operating range of the engine. Crankshaft tooth time refers to an amount of time between when a first tooth of a crankshaft is detected and when a second tooth of the crankshaft is detected. The RMSE and best correlation values may be determined between measured and non-measured cylinders crankshaft tooth times for different engine speeds and loads. RMSE and correlation values are determined at different engine speeds and loads because the values may change between different operating conditions.

The best correlation between an estimated variable and a measurement of the variable may be determined via a correlation coefficient as determined via the following equation:

$$\rho_{xy} = \frac{\mathrm{cov}(x, y)}{\sigma_x \sigma_y}$$

where $\rho_{xy}$ is the correlation coefficient, cov (x, y) is the covariance, $\sigma_x$ is standard deviation of x, and where $\sigma_y$ is the standard deviation of y, where x is the measured variable and y is the estimated variable. Correlation coefficients closest to a value of 1 are correlations of variables that are considered "best" values. Thus, correlation coefficients of variables of cylinders having values closest to one (e.g., highest values between 0 and 1) and lowest RMSE values are selected to receive pressure sensors. Method 900 proceeds to 908 after engine cylinders providing the lowest RMSE values for an engine parameter over the engine operating range are selected.

At 908, cylinder pressure sensors are installed in engine cylinders exhibiting the lowest RMSE values for the engine parameter over the engine operating range. In one example, the cylinder pressure sensors are incorporated into glow plugs that provide heat to engine cylinders. For example, as shown in FIGS. 4 and 5, cylinders numbered one and eight may receive cylinder pressure sensors. Thus, more than one engine cylinder of an engine is instrumented with a pressure sensor. Further, fewer than the total number of engine cylinders is instrumented with pressure sensors. For example, if the engine is an eight cylinder engine, at most seven cylinder pressure sensors may be placed into seven engine cylinders. Additionally, a table or map populated with entries that define which pressure sensor is to be applied to control combustion in engine cylinders at various engine operating conditions is stored in controller memory (e.g., a table similar to the table of FIG. 8). Method 900 proceeds to 910 after cylinder pressure sensors are installed in engine cylinders.

At 910, one or more pressure sensors are selected to provide engine feedback to the controller. The controller selects a pressure sensor based on operating conditions. In one example, the engine is operated combusting air and fuel. The sensor or sensors are selected from the table described at 908. Data from the pressure sensor or sensors is collected and is the basis for combustion control adjustments. For example, if the engine is operating at 2600 RPM and 3 bar load (e.g., cell 802 of FIG. 8), cylinder pressure data is collected from the first cylinder pressure sensor in the first cylinder (not necessarily cylinder number one) and the data is the basis for combustion adjustments in the remaining cylinders. Method 900 may determine engine torque, IMEP, MFB50, or other cylinder pressure derived engine parameters at 910 according to known methods. The cylinder pressure data may be collected for a single cylinder cycle or multiple cylinder cycles. Method 900 proceeds to 912 after cylinder data is collected and engine parameters are determined.

At 912, engine actuators are adjusted to adjust combustion in engine cylinders. The engine actuators are adjusted in response to data from the cylinder pressure sensors that were selected at 910. In one example, the actuators are fuel injectors and start of injection time, end of injection time, and/or amount of fuel injected may be adjusted to increase engine torque and/or adjust the timing of peak cylinder pressure during a cycle of the cylinder. Further, cam timing and throttle position may also be adjusted in response to cylinder pressure data and engine parameters determined from cylinder pressure data. If the engine is a spark ignited engine, spark timing may also be adjusted in response to cylinder pressure data. For example, if engine torque estimated from cylinder pressure data is less than desired, the amount of fuel injected may be increased and the throttle opening amount may also be increased. Method 900 proceeds to exit after engine actuators are adjusted in response to cylinder pressure data from selected cylinder pressure sensors.

The method of FIG. 9 provides for an engine operating method, comprising: evaluating operation of a plurality of engine cylinders for two or more engine cylinders, but less than the plurality of engine cylinders, that provide lowest root mean square error values based a parameter; and installing pressure sensors in two or more engine cylinders, but less than the plurality of engine cylinders, that provide the lowest root mean square error values based on the parameter. The method includes where the two or more engine cylinders includes only two engine cylinders that provide the lowest root mean square error value based on the parameter. The method includes where evaluating operation of the plurality of engine cylinders includes comparing estimates of engine torque based on pressure sensors in each of the plurality of engine cylinders against a measured engine torque, and where the estimates of engine torque include an engine torque estimate for each of the plurality of engine cylinders housing a pressure sensor.

In some examples, the method further comprises adjusting an engine actuator in response to output of the pressure sensors installed in the two or more engine cylinders. The method includes where the engine actuator is a fuel injector, and further comprising adjusting a fuel injector in at least one cylinder that does not include a pressure sensor in response to one or more of the installed pressure sensors. The method includes where evaluating operation of the plurality of engine cylinders includes operating an engine that includes the plurality of engine cylinders at a plurality of engine speed and load conditions. The method includes where the parameter is mass fraction of fuel burned.

The method of FIG. 9 also provide for an engine operating method, comprising: installing sensors in two or more engine cylinders, but less than all cylinders of an engine, that provide a lowest root mean square error values based on a parameter; receiving data from the sensors to a controller; and adjusting operation of all the cylinders in response to only a first sensor of the sensors at a first engine speed and load. The method includes where operation of all the cylinders is adjusted via adjusting an amount of fuel injected into each engine cylinder of the engine. The method further comprises adjusting operation of all the cylinders in response to only a second sensor of the sensors at a second engine speed and load.

In some examples, the method further comprises adjusting operation of all the cylinders in response to only two sensors of the sensors at a third engine speed and load. The method includes where operation of all the cylinders is adjusted via adjusting timing of fuel injected to all the cylinders. The method includes where the sensors are pressure sensors. The method includes where the lowest root mean square error values are error values of engine torque.

As will be appreciated by one of ordinary skill in the art, the method described in FIG. 9 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Further, the methods described herein may be a combination of actions taken by a controller in the physical world and instructions within the controller. At least portions of the control methods and routines disclosed herein may be stored as executable instructions in non-transitory memory and may be carried out by the control system including the controller in combination with the various sensors, actuators, and other engine hardware. Although not explicitly illustrated, one of ordinary skill in the art will recognize that one or more of the illustrated steps, methods, or functions may be repeatedly performed depending on the particular strategy being used.

In another representation, a method of operating an engine, such as a diesel common rail injection engine, is described. The method may include adjusting engine operation in response to sensed cylinder pressure. In one example, cylinder pressure may be sensed in a plurality of distinct cylinders of the engine, the engine having more than the plurality of cylinders, where cylinders other than the plurality of cylinders do not have cylinder pressure sensors. In one example, fuel injection amount and/or timing, etc. to all cylinders of the engine may be adjusted in response to cylinder pressure from a first of the cylinders during a first mode (and not response to cylinder pressure from a second of the cylinders), whereas during a different, second mode, fuel injection amount and/or timing, etc. to all cylinders of the engine may be adjusted in response to cylinder pressure from the second of the cylinders). In still a third mode, fuel injection amount and/or timing, etc. to all cylinders of the engine may be adjusted in response to cylinder pressure from both the first and second of the cylinders (e.g., via an averaging of the pressure readings crank-angle aligned). The first and second modes may be checker-boarded across the speed load map of the engine, such there are multiple discontinuous and distinct non-overlapping regions for each of the first and second modes. Further still, there may be a fourth operating mode where fuel injection amount and/or timings are not adjusted in response to either of the first and second cylinder pressure sensed values (e.g., the data from both sensors is ignored).

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine method, comprising:

evaluating operation of a plurality of engine cylinders, wherein the plurality of engine cylinders includes more than two cylinders, by instrumenting the engine with one or more pressure sensors and comparing a torque estimate for each cylinder of the plurality of engine cylinders, based on the instrumented one or more pressure sensors, at a controller;

selecting two or more engine cylinders, but less than all of the plurality of engine cylinders, that provide lowest root mean square error values based on a parameter, the parameter being a function of the comparing;

selectively installing a cylinder pressure sensor only in each of the selected two or more engine cylinders; and adjusting an engine actuator in each of the plurality of engine cylinders by the controller in response to an output of the installed cylinder pressure sensors relayed to the controller, where the plurality of engine cylinders includes at least one engine cylinder with no installed cylinder pressure sensor.

2. The method of claim 1, where the two or more engine cylinders include only two engine cylinders that provide the lowest root mean square error values based on the parameter, and wherein the installed pressure sensors are installed in the selected two or more engine cylinders that provide a highest value of correlation between estimated and measured values of the parameter.

3. The method of claim 1, wherein the evaluating operation of the plurality of engine cylinders includes comparing the pressure sensor based torque estimate for each cylinder of the plurality of engine cylinders against a crankshaft measured engine torque.

4. The method of claim 1, where the engine actuator is a fuel injector, and further comprising adjusting the fuel injector in at least one cylinder that does not include a pressure sensor in response to one or more of the installed pressure sensors.

5. The method of claim 1, where evaluating operation of the plurality of engine cylinders includes operating an engine that includes the plurality of engine cylinders at a plurality of engine speed and load conditions.

6. The method of claim 1, where the parameter is any mass fraction of fuel burned location from 0-100.

7. An engine operating method, comprising:

installing sensors in two or more engine cylinders, but less than all cylinders of an engine, wherein the two or more engine cylinders provide lowest root mean square error values for a parameter when the engine is instrumented with one or more pressure sensors;

receiving data from the installed sensors at a controller; and adjusting operation of all the cylinders, including operation of at least one cylinder with no installed sensor, in response to only a first sensor of the installed sensors at a first engine speed and load.

8. The method of claim 7, where operation of all the cylinders is adjusted via adjusting an amount of fuel injected into each engine cylinder of the engine.

9. The method of claim 7, further comprising adjusting operation of all the cylinders in response to only a second sensor of the installed sensors at a second engine speed and load.

10. The method of claim 7, further comprising adjusting operation of all the cylinders in response to only two sensors of the installed sensors at a third engine speed and load.

11. The method of claim 7, where operation of all the cylinders is adjusted via adjusting timing of fuel injected to all the cylinders.

12. The method of claim 7, where the sensors are pressure sensors.

13. The method of claim 12, where the lowest root mean square error values are error values of engine torque.

14. An engine system, comprising:

an engine having a plurality of cylinders including more than two cylinders;

a first installed pressure sensor protruding into a first of the plurality of cylinders;

a second installed pressure sensor protruding into a second of the plurality of cylinders; and a controller including instructions stored in non-transitory memory to adjust combustion in all of the plurality of engine cylinders, including in at least one engine cylinder with no pressure sensor installed, in response to output of the first pressure sensor and not output of the second pressure sensor at a first predetermined engine speed and load.

15. The engine system of claim 14, where the first of the plurality of cylinders has a lowest root mean square error value of engine torque as determined from output from a cylinder pressure sensor instrumented in the first of the plurality of cylinders at the first predetermined engine speed and load.

16. The engine system of claim 14, further comprising additional controller instructions to adjust combustion in all of the plurality of engine cylinders in response to output of the second pressure sensor and not output of the first pressure sensor at a second predetermined engine speed and load.

17. The engine system of claim 16, where the second of the plurality of cylinders has a lowest root mean square error value of engine torque as determined from output from a cylinder pressure sensor instrumented in the second of the plurality of combustion chambers at the second predetermined engine speed and load.

18. The engine system of claim 14, where the instructions adjusting combustion adjust fuel injection timing.

19. The engine system of claim 14, further comprising additional controller instructions to adjust combustion in all of the plurality of engine cylinders in response to output of either the first pressure sensor or the second pressure sensor at a third predetermined engine speed and load.

* * * * *